US012796878B2

(12) United States Patent
Ku et al.

(10) Patent No.: US 12,796,878 B2
(45) Date of Patent: Nov. 17, 2026

(54) SURFACE CLEANING APPARATUS WITH VAPOR DISPENSING

(71) Applicant: BISSELL Inc., Grand Rapids, MI (US)

(72) Inventors: Nim Chung Ku, Hong Kong (CN); Feng Chun Li, Shenzhen (CN)

(73) Assignee: BISSELL Inc., Grand Rapids, MI (US)

( * ) Notice: Subject to any disclaimer, the term of this patent is extended or adjusted under 35 U.S.C. 154(b) by 303 days.

(21) Appl. No.: 18/589,566

(22) Filed: Feb. 28, 2024

(65) Prior Publication Data

US 2024/0315511 A1 Sep. 26, 2024

Related U.S. Application Data

(60) Provisional application No. 63/453,255, filed on Mar. 20, 2023.

(51) Int. Cl.

| | |
|---|---|
| ***A47L 11/18*** | (2006.01) |
| ***A47L 11/202*** | (2006.01) |
| ***A47L 11/30*** | (2006.01) |
| ***A47L 11/34*** | (2006.01) |
| ***A47L 11/40*** | (2006.01) |

(52) U.S. Cl.

CPC ..... *A47L 11/185* (2013.01); *A47L 11/202* (2013.01); *A47L 11/302* (2013.01); *A47L 11/34* (2013.01); *A47L 11/4011* (2013.01); *A47L 11/4016* (2013.01); *A47L 11/4083* (2013.01); *A47L 11/4088* (2013.01); *A47L 11/4005* (2013.01); *A47L 2601/03* (2013.01)

(58) Field of Classification Search

CPC .... A47L 11/185; A47L 11/202; A47L 11/302; A47L 11/34; A47L 11/4011; A47L 11/4016; A47L 11/4083; A47L 11/4088; A47L 11/4005; A47L 2601/03

See application file for complete search history.

(56) References Cited

U.S. PATENT DOCUMENTS

| | | | | |
|---|---|---|---|---|
| 5,147,467 | A * | 9/1992 | Virtue | A47L 11/4038 15/98 |
| 8,806,703 | B2 * | 8/2014 | Bassett | A47L 11/4083 15/345 |
| 9,033,316 | B2 * | 5/2015 | Hansen | A47L 11/4088 261/78.2 |
| 9,186,032 | B2 * | 11/2015 | De Wit | A47L 11/34 |
| 10,092,155 | B2 * | 10/2018 | Xia | A47L 11/4041 |
| 11,013,389 | B2 * | 5/2021 | Resch | A47L 5/30 |
| 11,730,335 | B1 * | 8/2023 | Resch | A47L 11/4016 15/320 |

(Continued)

FOREIGN PATENT DOCUMENTS

| | | |
|---|---|---|
| CN | 112075890 | 12/2020 |
| CN | 113440065 | 9/2021 |

(Continued)

*Primary Examiner* — Marc Carlson

(74) *Attorney, Agent, or Firm* — Warner Norcross + Judd LLP

(57) ABSTRACT

A surface cleaning apparatus includes a vapor dispensing system and a recovery system. The vapor dispensing system may include a vapor generator and a vapor outlet that dispenses vapor toward a brushroll in order to wet the brushroll and clean a surface. Methods for operating a surface cleaning apparatus with a vapor dispensing system are also provided.

18 Claims, 7 Drawing Sheets

(56) References Cited

U.S. PATENT DOCUMENTS

| | | | | |
|---|---|---|---|---|
| 2018/0333736 | A1* | 11/2018 | Krebs | A47L 5/365 |
| 2021/0153708 | A1* | 5/2021 | Xia | A47L 5/28 |
| 2021/0169294 | A1* | 6/2021 | Pruiett | A47L 11/4016 |

FOREIGN PATENT DOCUMENTS

| | | | | |
|---|---|---|---|---|
| EP | 3162262 | | 2/2021 | |
| EP | 3834693 | | 6/2021 | |
| JP | H09141220 | A * | 6/1997 | B05B 17/0615 |

* cited by examiner

SURFACE CLEANING APPARATUS WITH VAPOR DISPENSING

CROSS-REFERENCE TO RELATED APPLICATION(S)

This application claims the benefit of U.S. Provisional Patent Application No. 63/453,255, filed Mar. 20, 2023, which is incorporated herein by reference in its entirety.

BACKGROUND

Multi-surface or wet/dry vacuum cleaners are adapted for cleaning hard floor surfaces such as tile and hardwood and soft floor surfaces such as carpet and upholstery. Some multi-surface vacuum cleaners comprise a liquid delivery system that delivers cleaning liquid to a surface to be cleaned and a recovery system that extracts spent cleaning liquid and debris (which may include dirt, dust, stains, soil, hair, and other debris) from the surface. The delivery system typically includes one or more supply tanks for storing a supply of cleaning fluid, a distributor for applying the cleaning liquid to the surface to be cleaned, and a supply conduit for delivering the cleaning liquid from the supply tank to the distributor. An agitator can be provided for agitating the cleaning liquid on the surface. The recovery system typically includes a recovery tank, a nozzle adjacent the surface to be cleaned and in fluid communication with the recovery tank through a working air conduit, and a source of suction in fluid communication with the working air conduit to draw the cleaning liquid from the surface to be cleaned and through the nozzle and the working air conduit to the recovery tank. At least some liquid is typically left behind on the floor surface, such that the floor surface remains wet after a cleaning operation.

Other cleaning apparatuses include steam mop that dispense steam, but do not recover liquid. Steam mops have an on-board steam generator that boils liquid to generate steam, and typically applies steam to a cleaning pad. Steam is typically applied to the backside of the cleaning pad and eventually saturates the entire cleaning pad as the moisture wicks outwardly from the point of steam application. The wetted pad is wiped across the floor surface to remove dirt, dust, and debris present on the floor surface. Due to the use of a saturated cleaning pad, the floor surface remains wet after a cleaning operation. The cleaning pad eventually becomes soiled with dirt, dust, and debris. The soiled mop pad can be disposed of, or laundered and re-used.

BRIEF SUMMARY

A surface cleaning apparatus with vapor dispensing is provided herein. In certain embodiments, the surface cleaning apparatus is a wet/dry vacuum cleaner or wet/dry multi-surface cleaner that can be used to clean hard floor surfaces such as tile and hardwood and soft floor surfaces such as carpet.

According to one aspect of the disclosure, a surface cleaning apparatus includes an upright body having a handle and a frame, a base coupled with the upright body and adapted for movement across a surface to be cleaned, the base having a brushroll chamber, a brushroll in the brushroll chamber, the brushroll rotatable about a brushroll axis, a recovery system comprising a suction inlet port in fluid communication with the brushroll chamber, a recovery tank, and a vacuum motor, and a vapor dispensing system having a supply container configured to store a liquid cleaning fluid, a pump in fluid communication with the supply container, a vapor generator in fluid communication with the pump and configured to receive liquid cleaning fluid from the supply container via the pump and to expel the cleaning fluid as vapor, and a mixing chamber within the brushroll chamber, wherein the vapor generator comprises a vapor outlet that dispenses vapor into the mixing chamber to wet the brushroll.

In this and other aspects of the disclosure, the surface cleaning apparatus can include a suction chamber within the brushroll chamber, wherein the suction inlet port is in fluid communication with the suction chamber, and the mixing chamber is substantially fluidly isolated from the suction chamber. A partition within the brushroll chamber can separate the mixing chamber from the suction chamber.

In this and other aspects of the disclosure, the base can include a cover at least partially defining the brushroll chamber, where at least a portion of the cover is transparent or translucent to permit a user to view the mixing chamber and observe the dispensing of vapor through the cover.

In this and other aspects of the disclosure, the base includes a squeegee adapted to contact the surface to be cleaned and/or an interference wiper interfacing with a portion of the brushroll.

In this and other aspects of the disclosure, the vapor generator can comprise a high-pressure spray nozzle comprising an outlet orifice forming the vapor outlet.

In this and other aspects of the disclosure, the vapor dispensing system can include a vibration generator configured to generate vapor from condensed cleaning fluid in the mixing chamber.

In this and other aspects of the disclosure, the vapor dispensing system can include a heater configured to provide heated liquid cleaning fluid to the vapor generator.

In this and other aspects of the disclosure, the surface cleaning apparatus may have a liquid dispenser disposed on the base, the liquid dispenser configured to dispense liquid cleaning fluid. A bypass conduit can bypass the vapor generator to supply liquid cleaning fluid to the liquid dispenser. A diverter valve can be provided and can be moveable between a first position wherein the diverter valve supplies liquid cleaning fluid to the vapor generator and a second position wherein the diverter valve supplies liquid cleaning fluid to the bypass conduit.

In this and other aspects of the disclosure, the surface cleaning apparatus may have a brushroll motor operably coupled with the brushroll. Optionally, the brushroll motor and the pump are disposed within the base.

In this and other aspects of the disclosure, the base can include a base housing and a cover releaseably attached to the base housing. The cover can be removable to access the brushroll. The cover can at least partially defines the mixing chamber.

In this and other aspects of the disclosure, the surface cleaning apparatus can have a moveable joint mounting the base to the upright body, wherein the upright body is pivotable via the joint between an upright stored position and a reclined use position.

In this and other aspects of the disclosure, the vapor dispensing system can dispense droplets having a diameter of about 30-50 microns.

According to yet another aspect of the disclosure, cleaning modes for a surface cleaning apparatus with a vapor dispensing system are also provided. The surface cleaning apparatus may have a controller that executes one or more cleaning modes.

According to still another aspect of the disclosure, methods for operating a surface cleaning apparatus with a vapor dispensing system are provided.

According to a further aspect of the disclosure, a surface cleaning apparatus includes a cleaning head adapted for movement across a surface to be cleaned, the cleaning head comprising an agitator chamber, an agitator in the agitator chamber, a recovery system comprising a suction inlet port in fluid communication with the agitator chamber and a vacuum motor, and a vapor dispensing system having a supply container configured to store a liquid cleaning fluid, a vapor generator configured to receive liquid cleaning fluid from the supply container and to expel the cleaning fluid as vapor, and a mixing chamber within the agitator chamber, wherein the vapor generator comprises a vapor outlet that dispenses vapor into the mixing chamber to wet the agitator.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION

Figure 1:
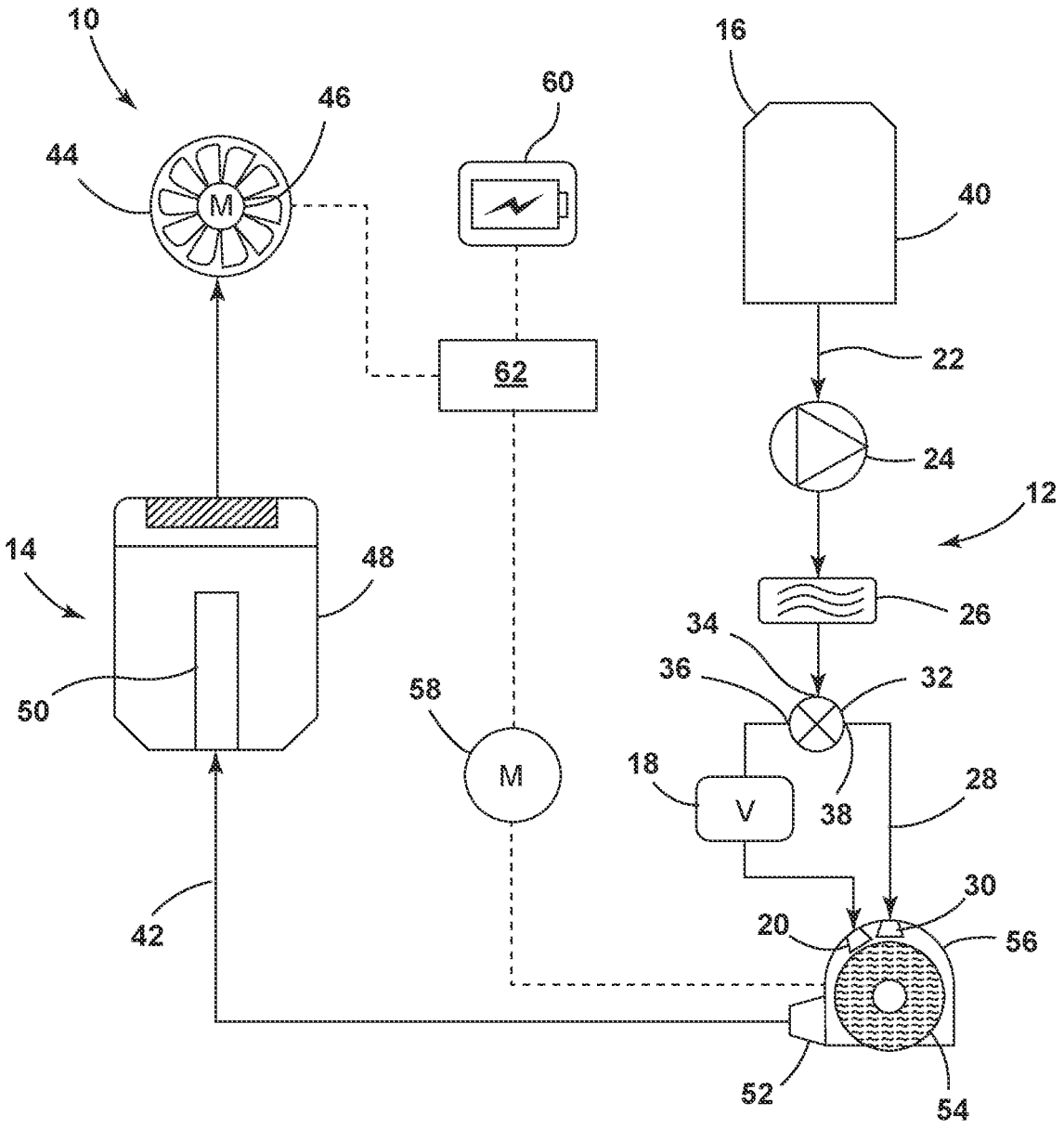
FIG. 1 is a schematic view of a floor cleaner having vapor dispensing according to one aspect of the disclosure.

The invention generally relates to a surface cleaning apparatus for cleaning a floor surface with vapor dispensing. Aspects of the disclosure described herein are further related to an upright wet/dry vacuum cleaner or wet/dry multi-surface cleaner that can dispense vapor to clean hard floor surfaces such as tile and hardwood and soft floor surfaces such as carpet. The use of vapor provide low moisture, low flowrate, and/or low fluid volume cleaning, while minimizing drying time and/or energy consumption.

As used herein, the term "vapor" includes a cleaning fluid at least partially converted to a vapor phase or mist that is generated by subjecting cleaning fluid in a liquid phase to mechanical force or energy to at least partially convert the liquid cleaning fluid to a vapor phase or mist. Vapor can, for example, generated on the surface cleaning apparatus via one or more mechanical mechanisms, including, but not limited to, high pressure movement of liquid through a nozzle or orifice, high frequency mechanical oscillation of liquid, and/or high velocity discharge of liquid against a stationary or rotating target. The vapor may be at, below, or above ambient temperature, alternatively less than 100 °C, alternatively less than 90 °C, alternatively about 20 to less than 90 °C, alternatively about 25 to about 85 °C, alternatively about 45 to about 85 °C, and/or may have a droplet diameter of about 30-100 microns, alternatively about 30-50 microns. The vapor can be invisible to the naked eye, in the form of a visible vapor that can be observed by the naked eye, or combinations thereof. The liquid cleaning fluid may or may not be heated by a heat source on board the surface cleaning apparatus prior to the vapor conversion.

As used herein, the term "steam" includes a cleaning fluid at least partially converted to a gas or vapor phase by boiling or otherwise heating the cleaning fluid to around 100±10 °C, alternately about 90 to 100 °C, alternatively about 95 to 98 °C, and/or may have a droplet diameter of about 10-20 microns.

As used herein, the term "liquid" includes a cleaning fluid in a liquid phase having a temperature below the temperature of steam, including but not limited to 32 to 55 °C. The liquid may or may not be heated by a heat source on board the surface cleaning apparatus.

As used herein, the term "cleaning fluid" may encompass liquid, vapor, steam, or any mixture thereof, and may include the presence of a surface cleaning and/or treatment agent. Examples of cleaning fluids are water or solutions containing water (like water mixed with a cleaning chemistry, fragrance, etc.). Examples of treatment agents include, but are not limited to, sanitizing agents.

As used herein, the term "debris" includes dirt, soil, dust, hair, stains, and other debris, unless otherwise noted.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source. As used herein, the term "multi-surface" or "wet/dry" vacuum cleaner includes a vacuum cleaner that can be used to clean hard floor surfaces such as tile and hardwood and soft floor surfaces such as carpet.

FIG. 1 is a schematic view of a surface cleaning apparatus or floor cleaner 10 according to one aspect of the present disclosure. As discussed in further detail below, the floor cleaner 10 is provided with vapor dispensing, which is described in further detail below. The floor cleaner 10 can include multiple cleaning systems, including a vapor dispensing system 12 and a recovery system 14. While referred to a "floor" cleaner, it is understood that the apparatus may be configured to clean non-floor surfaces as well.

The vapor dispensing system 12 can include a source of liquid cleaning fluid 16, a vapor generator 18 that converts liquid cleaning fluid to vapor, and a vapor outlet 20 that dispenses vapor.

The vapor generator 18 can generate vapor by one or more mechanical mechanisms, including, but not limited to, high pressure movement of liquid cleaning fluid through a nozzle or orifice, high frequency mechanical oscillation of liquid cleaning fluid, and/or high velocity discharge of liquid cleaning fluid against a stationary or rotating target. It is noted that, in some embodiments, the vapor outlet 20 may be integrated with the vapor generator 18. For example, the vapor generator 18 can comprise a high-pressure spray nozzle having an outlet forming the vapor outlet 20.

The vapor dispensing system 12 can include other conduits, ducts, tubing, hoses, connectors, valves, etc. fluidly coupling the components of the system 12 together and providing a supply path 22 from the source of cleaning fluid 16 to the vapor outlet 20.

The vapor dispensing system 12 can include a flow controller to control the flow of fluid from the source 16 to the vapor generator 18. In one configuration, the flow controller can comprise a pump 24 that pressurizes the path 22 and controls the delivery of liquid cleaning fluid to the vapor generator 18. In one example, the pump 24 can be a centrifugal pump. In another example, the pump 24 can be a solenoid pump.

In some embodiments, the pump 24 can have multiple speeds and/or flow rates so that a flow rate of cleaning fluid out of the vapor generator 18 can be varied. For example, the floor cleaner 10 can use pulse width modulation (PWM) to adjust the pump voltage to achieve and/or maintain a desired flow rate. The floor cleaner 10 can have one or more cleaning modes with predetermined flow rate parameters for the pump 24. Alternatively, the floor cleaner 10 can have an input control (not shown) for manual user control of pump speed and/or flow rate.

In another embodiment of the vapor dispensing system 12, the pump 24 can be eliminated and the flow controller can comprise a gravity-feed system having a valve (not shown) fluidly coupled with an outlet of the fluid source 16, whereby when the valve is open, fluid will flow under the force of gravity to the vapor generator 18.

In some embodiments, the vapor dispensing system 12 includes a heater 26 for heating the liquid cleaning fluid. The heater 26 preferably heats the cleaning fluid to less than 100 °C, alternatively less than 90 °C, alternatively about 20 to less than 90 °C, alternatively about 25 to about 85 °C, alternatively about 45 to about 85 °C, alternately around 85 °C. This temperature may be the temperature of cleaning fluid at the vapor generator 18. The heater 26 itself may operate at a higher temperature, as some heat loss between the heater 26 and the vapor generator 18 is possible, particularly when the system and its components are heating up and/or pressurizing. In other embodiments, the vapor dispensing system 12 does not include a heater. In yet another embodiment, the liquid cleaning fluid can be heated using exhaust air from a motor-cooling pathway for a motor/fan assembly, instead of or in addition to a heater.

The heater 26, when present, can be located downstream of the fluid source 16 and upstream of the pump 24. Prior to reaching the vapor generator 18, the heated cleaning fluid may include cleaning fluid in a liquid phase. Some non-limiting examples of a suitable heater 26 include, but are not limited to, a thick film heater, a tubular heater, a positive temperature coefficient (PTC) heater, or a cast heater. In one preferred embodiment, the heater 26 is not a steam generator, e.g., does not generate steam.

In some embodiments, the vapor dispensing system 12 can include a bypass conduit 28 that bypasses the vapor generator 18 to supply liquid cleaning fluid to a liquid outlet 30. For example, the liquid outlet 30 can be used for self-cleaning the floor cleaner 10 and/or for a liquid wash cycle, described in further detail below.

The bypass conduit 28 can include one or more conduits, ducts, tubing, hoses, connectors, valves, etc. providing a liquid flow path to the liquid outlet 30. For example, in one embodiment, the vapor dispensing system 12 includes a diverter valve 32 that selectively diverts liquid cleaning fluid to the vapor generator 18 or to the bypass conduit 28. The diverter valve 32 can comprise an inlet 34 in fluid communication with the pump 24, or heater 26 if present, a first outlet 36 in fluid communication with the vapor generator 18, and a second outlet 38 in fluid communication with the bypass conduit 28. The diverter valve 32 can be a mechanically controlled or electrically controlled valve, and may be controlled via the mode button 88 or by another actuator on the floor cleaner 10. In some embodiments, the diverter valve 32 may be actuated automatically by the docking of the floor cleaner 10 on a tray 150.

The fluid source 16 can include at least one supply container 40 for storing a supply of liquid cleaning fluid. In another embodiment, the vapor dispensing system 12 can have an additional supply container (not shown) for storing a liquid cleaning fluid. For example, the first supply container 40 can store water and the second supply container can store a cleaning agent such as detergent. The supply containers can, for example, be defined by a supply tank and/or a collapsible bladder. Alternatively, a single container can define multiple chambers for different cleaning fluids. In embodiments where multiple supply containers are provided, the system 12 can have with a mixing system for controlling the composition of the cleaning fluid that is delivered to the vapor generator 18.

The recovery system 14 removes liquid and/or debris from the surface to be cleaned and stores the spent cleaning fluid and debris on the floor cleaner 10. The recovery system 14 can include a recovery path 42 through the cleaner 10 having a path inlet and a path outlet, a suction source 44 including a vacuum motor 46 in fluid communication with the path inlet for generating a working air stream through a recovery path 42, and a recovery container 48 for separating and collecting fluid and debris from the working airstream for later disposal. A separator 50 can be formed in a portion of the recovery container 48 for separating fluid and entrained debris from the working airstream.

In one embodiment, the path inlet can include a suction inlet port 52 disposed on a cleaning head or base, and the path inlet can be defined by a suction nozzle, a brush chamber, and/or a brushroll cover, or any combination thereof, as described in more detail below.

The floor cleaner 10 can include at least one agitator to agitate the surface to be cleaned. In one embodiment, the agitator is a rotating brushroll 54. The vapor outlet 20 delivers vapor onto the brushroll 54 or into a chamber 56 containing the brushroll 54. In one non-limiting example, the suction inlet port 52 is positioned in close proximity to the brushroll 54 to collect liquid and debris directly from the brushroll 54. Other examples of agitators include, but are not limited to, dual horizontally-rotating brushrolls, one or more vertically-rotating brushes, a stationary brush, or a cleaning pad.

A drive assembly including a brushroll motor 58 can drive the brushroll 54. A drive transmission (not shown) operably connects the motor 58 with the brushroll 54 for transmitting rotational motion of the motor 58 to the brushroll 54. In other embodiments, a drive transmission can operably connect the brushroll 54 with the vacuum motor 46 to transmit rotational motion of the vacuum motor 46 to the brushroll 54.

The floor cleaner 10 can be provided with above-the-floor cleaning features (not shown), including, but not limited to, an accessory hose and an above-the floor cleaning tool with its own suction inlet and/or fluid dispenser.

Electrical components of the floor cleaner 10, including the pump 24, heater 26, vacuum motor 46, brushroll motor 58, or any combination thereof, are electrically coupled to a power source 60, which can comprise a power cord plugged into a household electrical outlet or a battery for cordless operation. In one embodiment, the power source 60 comprises a rechargeable battery for cordless operation. In some embodiments, the vapor generator 18 and/or diverter valve 32 can comprise or include electrical components, and may be electrically coupled to the power source 60 as well.

The floor cleaner 10 can include at least one controller 62 operably coupled with the various function systems and components of the floor cleaner 10. In one embodiment the controller 62 can comprise a printed circuit board ("PCB"). As used herein, unless otherwise noted, the term "PCB" includes a printed circuit board having a plurality of electrical and electronic components that provide operational control to the floor cleaner 10. The PCB includes, for example, a processing unit (e.g., a microprocessor, a microcontroller, or another suitable programmable device) and a memory (e.g., a read-only memory ("ROM"), a random access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, a PCB and the electrical components populated on the PCB are collectively referred to as a controller. Thus, the main PCB and the electrical components populated on the main PCB may be referred to as controller 62.

The floor cleaner 10 can be used to effectively clean a surface in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from aspects described herein.

In operation, the floor cleaner 10 is prepared for use by filling the supply container 40 with cleaning fluid. The user powers the floor cleaner 10 and activates the vapor system 12, for example via the user interface 82, and vapor exists the vapor outlet 20. Preferably, the vapor outlet 20 positioned to deliver vapor into the mixing chamber 94 and/or toward the brushroll 54. The vapor is applied in a generally uniform volume over the brushroll 54 to evenly wet, but not overly wet or soak, the brushroll 54. The application of vapor according to this embodiment and other embodiments disclosed herein provides low moisture, low flowrate, and/or low fluid volume cleaning. Activation of the vapor system 12 can include powering the pump 24 and/or heater 26. Simultaneously, the brush motor 58 can be powered to rotate the brushroll 54. The wetted, rotating brushroll 54 mops the surface to be cleaned, including agitating stuck on debris or stains for easier removal. Simultaneously, the user can move the floor cleaner back and forth over the surface. By directing a vaporized cleaning fluid toward the brushroll 54, the brushroll 54 is evenly wetted, which improves the cleaning efficacy of the brushroll 54 and reduces streaking on the floor surface.

The recovery system 14 may also be activated for simultaneous vacuuming with mopping. Activation of the vapor system 12 can include powering the vacuum motor 46. As the floor cleaner 10 moves over the surface to be cleaned, soiled cleaning fluid and debris near is drawn into the suction inlet port 52 and the recovery path 42. Simultaneous vacuuming and vapor dispensing reduces cleaning time for the user.

Another advantage of dispensing vapor, in comparison to similar floor cleaners that dispense liquid, is that drying time is reduced. Since the vapor wets the brushroll 54 without over-wetting or soaking, agitation of the surface to be cleaned by the brushroll 54 does not result in significant liquid transfer to the surface to be cleaned. The vapor-wetted brushroll 54 transfers a thin, even layer of liquid to the surface. In the case of hard floor surfaces, the thin, even layer of liquid remains on top of the surface and can evaporate quickly for reduced drying time. Even in the case of soft floor surfaces like carpet, the thin, even layer of liquid may dampen the carpet fibers, but does not overly wet the carpet fibers.

Yet another advantage of dispensing vapor in comparison to similar floor cleaners that dispense steam, is that less power is required to operate the floor cleaner 10. Traditional floor cleaners with steam dispensing have heaters operating around 1500 W. The floor cleaner disclosed herein requires much lower energy to generate and dispense vapor, such as needing only around 50 W for cleaning a floor surface using non-heated vapor and around 180 W-200 W for cleaning a floor surface using heated vapor (i.e., by operating heater 26). Power levels may vary depending on the temperature and flow rate of dispensed cleaning fluid.

Optionally, the floor cleaner 10 may perform vacuuming without vapor dispensing (e.g., by activating the recovery system 14 and not activating the vapor system 12) and vice versa. As yet another option, in some embodiments, the floor cleaner 10 can dispense liquid from outlet 30 to clean a surface.

Figure 2:
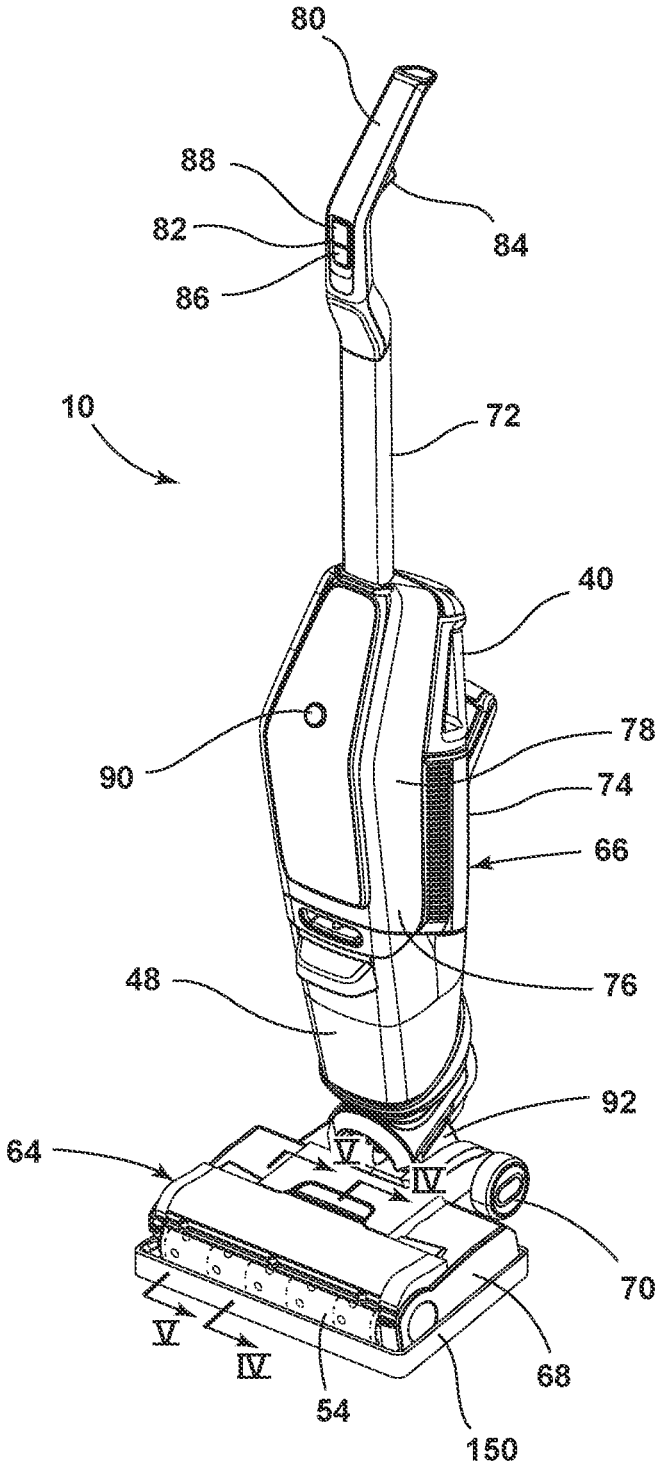
FIG. 2 is a perspective view of the floor cleaner of FIG. 1 embodied as an upright wet/dry vacuum cleaner.

FIG. 2 shows the floor cleaner 10 as an upright wet/dry floor cleaner having a housing that includes a cleaning head in the form of a base 64 adapted to move over a surface to be cleaned and an upper housing in the form of an upright body 66 coupled with the base 64 to direct the base 64 over the surface to be cleaned. The floor cleaner 10 can comprise the various systems and components schematically described for FIG. 1, including the vapor dispensing system 12 and the recovery system 14. The various systems and components schematically described for FIG. 1 can be supported by either or both the base 64 and the upright body 66.

As used herein, the term upright floor cleaner is intended to refer to various types of floor cleaners including, but not limited to, upright floor cleaners, stick floor cleaners, convertible floor cleaners (e.g., a floor cleaner capable of being used as an upright- or stick-type cleaner as well as a handheld cleaner), lift-off floor cleaners (e.g., a floor cleaner capable of being used as an upright-type cleaner as well as a canister type cleaner), and the like, or combinations thereof.

For purposes of description related to the figures, the terms "upper," "lower," "right," "left," "rear," "front," "vertical," "horizontal," "inner," "outer," and derivatives thereof shall relate to the disclosure as oriented in FIG. 2 from the perspective of a user behind the floor cleaner 10, which defines the rear of the floor cleaner 10. However, it is to be understood that the disclosure may assume various alternative orientations, except where expressly specified to the contrary.

The base 64 can comprise any type of base, foot, or other cleaning head suitable for the purposes described herein, including being moved over a floor surface to be cleaned. In one embodiment, the base 64 includes a base housing 68 supporting components of the systems 12, 14. Wheels 70 can at least partially support the base housing 68 for movement over the surface to be cleaned.

The upright body 66 can comprise any type of elongated handle, wand, body, or combination thereof suitable for the purposes described herein, including for a user to maneuver the floor cleaner 10 over a floor surface to be cleaned. In one embodiment, the upright body 66 includes a handle 72 and a frame 74. The frame 74 can comprise a main support section supporting components of the systems 12, 14, including, but not limited to, the supply container 40 and the recovery container 48. The frame 74 may include, for example, a motor housing 76 that contains the suction source 44 (FIG. 1) and/or a battery housing 78 that contains the battery 60 (FIG. 1).

The elongated handle 72 can extend upwardly from the frame 74 and can be provided with a hand grip 80 at one end that can be gripped by a user to maneuver the floor cleaner 10 over a surface to be cleaned.

Appropriate switches, buttons, triggers, actuators, and the like can be provided for user control of the vapor dispensing system 12 and the recovery system 14. The floor cleaner 10 may include at least one user interface ("UI") 82 through which a user can interact with the floor cleaner 10 to accomplish one or more functions. The UI 82 can, among other abilities, accept user inputs for controlling the cleaning systems and/or function as a communication output device for the cleaning systems. To accept user inputs, the UI 82 can have at least one user input control operably connected to one or more components or systems of the floor cleaner 10 to affect and control its operation. Non-limiting examples of input controls include buttons, triggers, toggles, keys, switches, or the like, or any combination thereof.

In some embodiments the UI 82 may have an output functionality. For example, the UI 82 may, in some embodiments, include at least one status indicator that communicates a condition or status of the floor cleaner, including systems and components thereof, to the user. The UI 82 can also include an auditory output component, such as a speaker.

In one embodiment, the UI 82 includes at least one of a trigger 84, a power button 86, a mode button 88, a self-cleaning button 90, or any combination thereof.

The trigger 84 can control the delivery of vapor by the vapor dispensing system 12. For example, the release of vapor can be controlled by the trigger 84, where depressing the trigger 84 releases vapor from the vapor outlet 20 (FIG. 1). In some embodiments, release of unheated vapor vs. heated vapor from the vapor outlet 20 upon depression of the trigger 84 can be mode-dependent. In one embodiment, the mode button 88 controls the cleaning mode, with the trigger 84 controlling the release of vapor.

In one embodiment, the trigger 84 can operate the pump 24 (FIG. 1), where depressing the trigger 84 turns the pump 24 on to pressurize the path 22, thereby providing cleaning liquid to the vapor generator 18. Release of the trigger 84 de-activates the pump 24 and stops vapor dispensing.

The trigger 84 can be mounted to the hand grip 80, or elsewhere on the upright body 66 and can project at least partially exteriorly of the hand grip 80 for user access. Other input controls, such as a thumb switch, can be provided to control vapor delivery instead of the trigger 84.

The power button 86 can be configured to control the supply of power to one or more electrical components of the floor cleaner 10, e.g. the power button 86 can turn the floor cleaner 10 "on" and "off."

The mode button 88 can be configured to cycles the floor cleaner 10 between different cleaning modes, as described in further detail below For example, cleaning modes can have associated operating parameters for the vapor generator 18, pump 24, heater 26, diverter valve 32, vacuum motor 46, brushroll motor 58, or any combination thereof. The controller 62 can operate those components according to the associated operating parameters of the user-selected cleaning mode.

The clean-out cycle button 90 is configured to activate and de-active a self-cleaning mode of the floor cleaner 10 in which the controller 62 (FIG. 1) executes an automatic, unattended clean-out cycle. For example, the clean-out cycle can have associated operating parameters for the vapor generator 18, pump 24, heater 26, diverter valve 32, vacuum motor 46, brushroll motor 58, or any combination thereof. The controller 62 can automatically operate those components according to the associated operating parameters of the clean-out cycle upon user selection of the clean-out cycle button 90.

The upright body 66, or more particularly the handle 72, or more particularly the hand grip 80, can include at least a portion of the UI 82. The UI 82 can conveniently be located adjacent to the grip 80, so that a user may hold the grip 80 in one hand and operate the UI 82 with the same hand. For example, a user may wrap their palm and fingers around the grip 80, and operate buttons 86, 88 using the thumb of the same hand. Similarly, the trigger 84 can conveniently be located adjacent to the grip 80 and the user may operate the trigger 84 using the forefinger of the same hand holding the grip 80. Other locations for the UI 82 are possible, including locations where the user must hold the grip 80 in one hand and operate the UI 82 with their other hand. Such locations include, but are not limited to, on a portion of the upright body 66 other than the grip 80 or on the base 64. In other embodiments, components of the UI 82 may be distributed across multiple portions of the floor cleaner 10. For example, in the embodiment shown, the self-cleaning button 90 is provided on the frame 74, although it is understand that the button 90 can be provided on the grip 80 or elsewhere on the floor cleaner 10.

A moveable joint 92 can connect the base 64 to the upright body 66 for movement of the upright body 66 about at least one axis. In the embodiment shown herein, the upright body 66 can pivot up and down about at least one axis relative to the base 64. The joint 92 can alternatively comprise a universal joint, such that the upright body 66 can swivel about its longitudinal axis in addition to pivoting relative to the base 64. The upright body 66 can pivot, via the joint 92, between an upright or storage position, an example of which is shown in FIG. 2, and a reclined or use position (not shown), in which the upright body 66 is pivoted rearwardly to form an acute angle with the surface to be cleaned. A joint lock (not shown) can selectively engage and lock the upright body 66 in the upright or storage position.

Wiring and/or conduits can optionally supply electricity, air, liquid, vapor, or any combination thereof, between the upright body 66 and the base 64, or vice versa, and can extend though the joint 92 or exteriorly of the joint 92. As such, in some embodiments, a portion of the systems 12, 14 can extend through the joint 92. For example, the supply and recovery paths 22, 42 (FIG. 1) can extend through the joint 92.

Figure 3:
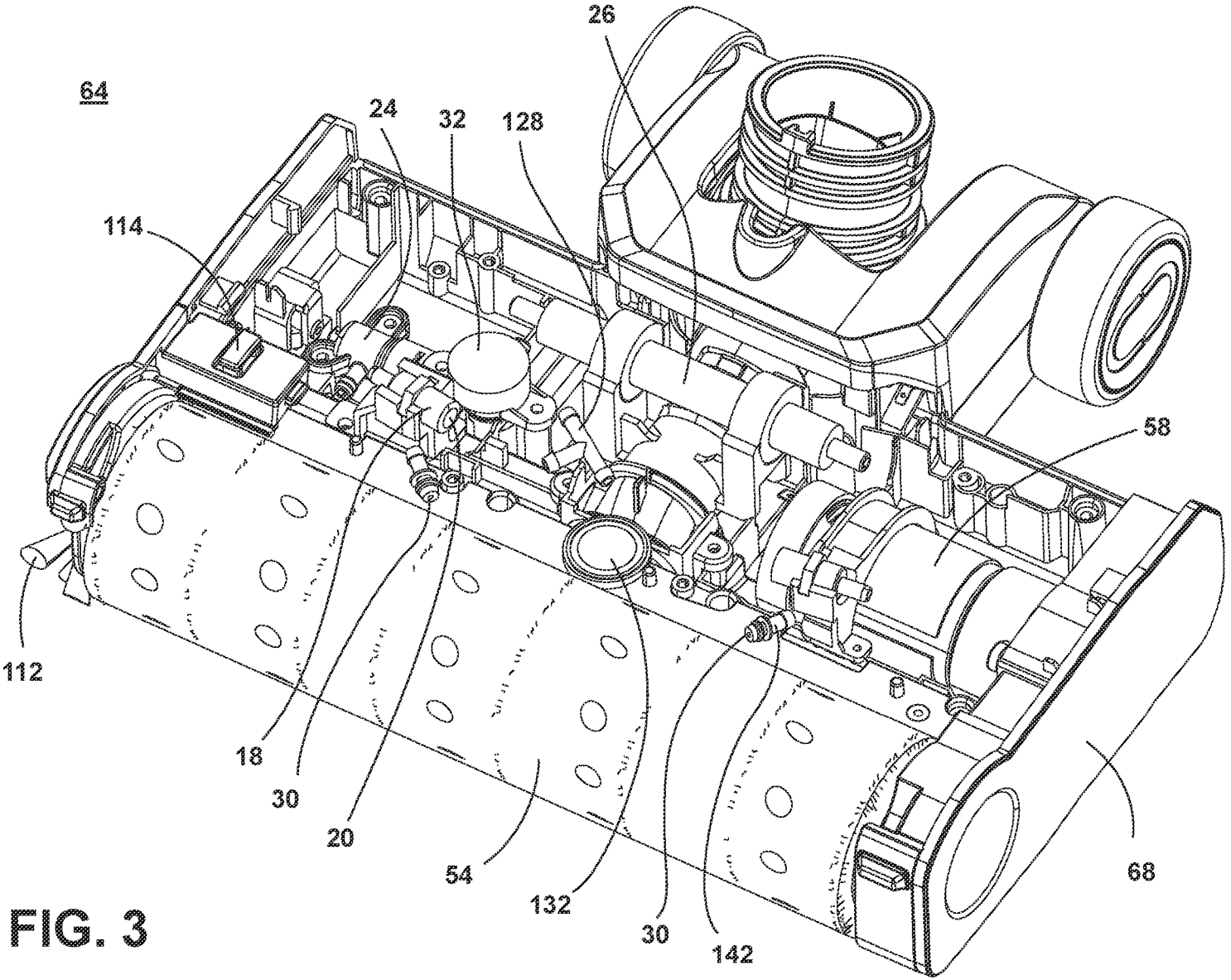
FIG. 3 is a perspective view of a base of the floor cleaner of FIG. 2, with portions of the base removed for clarity.
Figure 4:
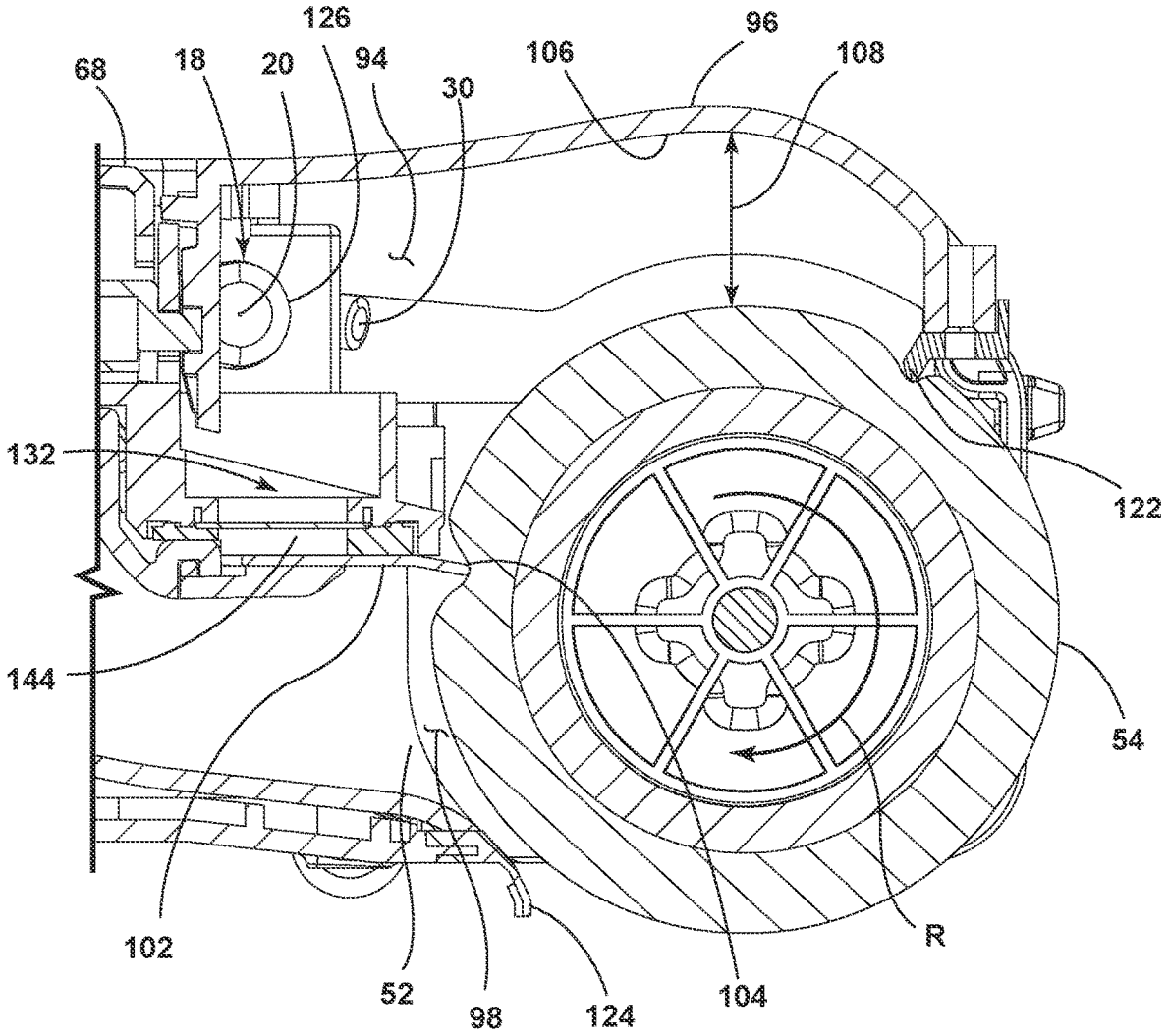
FIG. 4 is a cross-sectional view of a portion of the base taken through line IV-IV of FIG. 2.

FIGS. 3-4 show the base 64 according to one aspect of the disclosure, including locations and relative positions for components of the vapor and recovery systems, including, but not limited to the vapor generator 18, the vapor outlet 20, the pump 24, the heater 26, the liquid outlet 30, the diverter valve 32, the suction inlet port 52, the brushroll 54, the brushroll motor 58. For clarity, one or more housing pieces and/or covers of the base 64 are not shown in FIG. 3. Also for clarity, conduits fluidly connecting the pump 24 to the supply tank 40 (FIG. 2), the heater 26 to the pump 24, the diverter valve 32 to the heater 26, the liquid outlet 30 to the diverter valve 32, and the vapor generator 18 to the diverter valve 32 are not shown in FIG. 3.

Referring to FIG. 4, the base 64 includes brushroll chamber 56 in which the brushroll 54 is disposed. The vapor dispensing system 12 can include a mixing chamber 94 within the brushroll chamber 56, and the vapor outlet 20 dispenses vapor into the mixing chamber 94 to wet the brushroll 54.

The base 64 can include a cover 96 enclosing the brushroll 54 and at least partially defining the brushroll chamber 56, and in at least some embodiments, at least partially defining the mixing chamber 94.

The cover 96 may be removably or non-removably attached to the base housing 68. In one embodiment, the cover 96 is removable to access the brushroll 54. With the cover 96 removed, the brushroll 54 can be removed from the base 64, for example for cleaning or replacement. Removal of the cover 96 can also expose the vapor generator 18, vapor outlet 20, the liquid outlet 30, or any combination thereof. Optionally, a cover latch releasably secures the cover 96 on the base housing 68.

In one aspect, at least a portion of the cover 96, in particular a portion of the cover 96 defining the mixing chamber 94, is transparent or translucent so that the mixing chamber 94 is viewable through the cover 96. The dispensing of vapor into the mixing chamber 94 and/or the condensation of vapor within the mixing chamber 94 can therefore be observed by the user through the cover 96. This offers a visual confirmation to the user that vapor is being dispensed by the floor cleaner 10. A transparent or translucent cover 96 may additionally, for example, allow a user to view the brushroll 54 from the exterior of the base 64.

The recovery system 14 can include a suction chamber 98 within the brushroll chamber 56, and the suction inlet port 52 is in fluid communication with the suction chamber 98. The suction inlet port 52 and/or suction chamber 98 can be configured to extract liquid and debris from the brushroll 54 and from the surface to be cleaned. The suction inlet port 52 and/or the suction chamber 98 can be positioned in close proximity to the brushroll 54. By way of non-limiting example, the suction inlet port 52 and the suction chamber 98 can be disposed rearwardly of the brushroll 54.

A working airflow conduit 100 extends from the suction chamber 98 to the recovery container 48 (FIG. 2) and defines a portion of the recovery path 42. The conduit 100 can include at least one conduit, duct, tubing, hose, or combinations thereof, to fluidly couple the suction chamber 98 to the recovery container 48.

The conduit 100 can extend through the joint 92 to pass from the base 64 to the upright body 66. In one embodiment, the conduit 100 can pass through the base 64 between the pump 24 and the brush motor 58. One or more portions of the conduit 100 can be flexible to facilitate movement of the joint 92.

The mixing chamber 94 is substantially fluidly isolated from the suction chamber 98, and therefore from the suction inlet port 52, the conduit 100, and other components of the recovery system 14. In being "substantially" fluidly isolated, some cleaning fluid may escape the mixing chamber 94 in vapor form, but the majority (e.g., over 90%, alternatively over 95%) does not escape the mixing chamber 94 with the brushroll 54 rotating and the vacuum motor 46 operating. This isolation forces vapor to remain in the mixing chamber 94 to wet the brushroll 54, rather than being drawn immediately into the suction inlet port 52.

The floor cleaner 10 can include a partition 102 within the brushroll chamber 56, the partition 102 separating the mixing chamber 94 from the suction chamber 98. The partition 102 can be impermeable to vapor and/or liquid cleaning fluid, such that vapor and/or liquid cleaning fluid cannot pass through the partition 102.

In one embodiment, the partition 102 is disposed rearwardly of the brushroll 54, the mixing chamber 94 is defined above the partition 102, and the suction chamber 98 is defined below the partition 102. With this arrangement, an upper portion of the brushroll 54 is exposed to the mixing chamber 94 and is therefore wetted with vapor moving within the mixing chamber 94, and a lower portion the brushroll 54 is exposed to the suction chamber 98. With the brushroll rotating in direction R about its rotational axis B, a newly wetted portion of the brushroll 54 rotates into contact with the surface. Continuing around the rotational path, this portion, now soiled with debris and dirty fluid, rotates into the position where it is exposed to the suction chamber 98, and dirty fluid and debris are removed from the soiled portion of the brushroll 54. Next, this portion of the brushroll 54, now relatively clean, rotates into the position where it is exposed to the mixing chamber 94 to be re-wetted.

The partition 102 can contact the brushroll 54 and can project into the brushroll 54 to create a seal with material of the brushroll 54 in order to separate the mixing chamber 94 from the suction chamber 98. In one non-limiting example, the partition 102 projects 2 to 5 mm into the brushroll 54, which ensures a good seal without creating undue drag on the rotating brushroll 54. In one embodiment, the brushroll 54 can comprise a microfiber or other compressible material, and the partition 102 can include a forward edge 104 that presses into the microfiber or other compressible material of the brushroll 54.

The partition 102 can be rigid, i.e., stiff, and non-flexible, so the partition 102 does not yield or flex by engagement with the brushroll 54. In one embodiment, the partition 102 can be formed of stainless steel. In another embodiment, the partition 102 can be formed of rigid thermoplastic material. In other embodiments, the partition 102 can be flexible.

At least a portion of the cover 96 can be spaced from the brushroll 54 to provide a clearance for vapor to move within the mixing chamber 94 and disperse over the exposed portion of the brushroll 54. A portion of the mixing chamber 94 is defined between a top of the brushroll 54 and an underside 106 of the cover 96, and the mixing chamber 94 can have a clearance 108 of at least 5 mm between the top of the brushroll 54 and the underside 106 of the cover 96, alternatively about 5 to 10 mm.

The volume of the mixing chamber 94 may be greater than the volume of the suction chamber 98. A larger mixing chamber 94 provides more space for vapor to disperse over the exposed portion of the brushroll 54, while a smaller suction chamber 98 increases the velocity of suction air drawn at the suction chamber 98.

In some embodiments, the cover 96 does not form a suction nozzle surrounding the brushroll 54. As shown in FIG. 4, a leading portion of the brushroll 54 may be exposed at a leading edge of the base 64, and rear lower quadrant of the brushroll 54 may be exposed to the suction chamber 98 and therefore to vacuum force generated by the recovery system, and an upper rear and/or top of the brushroll 54 may be exposed to the mixing chamber 94 and therefore to dispensed vapor.

Figure 6:
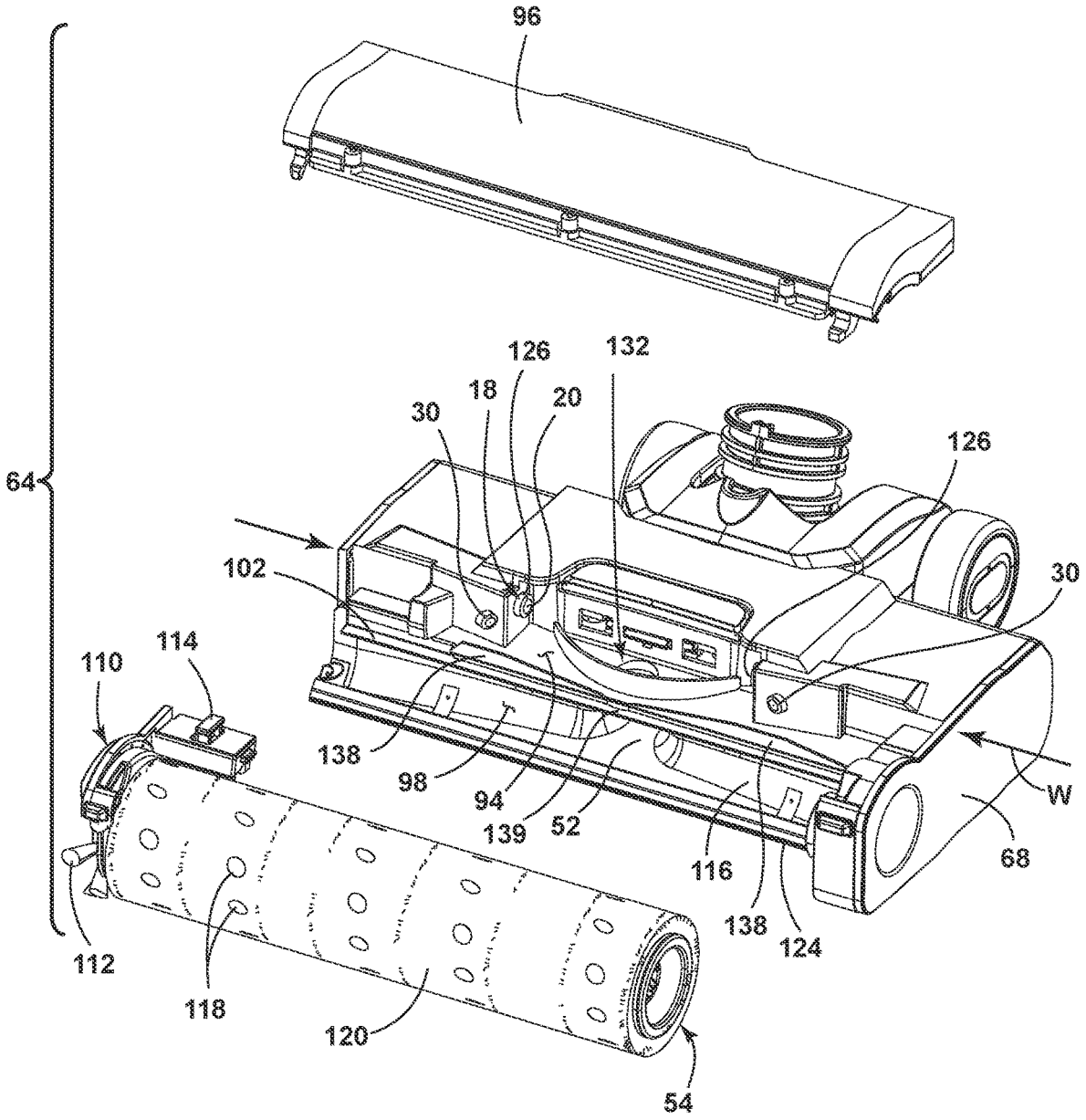
FIG. 6 is a partially exploded perspective view of the base.

Referring to FIG. 6, a perspective view of the base 64 is shown with the cover 96 and the brushroll 54 removed from the base housing 68. In the embodiment shown, the brushroll 54 is part of a removable assembly 110 including an edge brush 112 and a latch 114 that secures the assembly 110 to the base housing 68. A portion of the assembly 110 can enclose an end of the mixing chamber 94 and/or an end of the suction chamber 98. It is understood that, in other embodiments, the brushroll 54 may be removable on its own, e.g., without the edge brush 112 and/or the latch 114, and may be removable without or without first removing the cover 96.

The suction chamber 98 can be at least partially defined by a rear chamber wall 116. The suction inlet port 52 can be defined by or be connected to the rear chamber wall 116. The suction chamber can also be at least partially defined by the partition 102, such as by an underside of the partition 102.

The mixing chamber 94 and/or the suction chamber 98 can extend substantially across a width W of the base 64, with the width being defined between lateral sides of the base 64. For example, the mixing chamber 94 can extend at least 50% of the width W, alternatively at least 60% of the width W, alternatively at least 70% of the width W, alternatively at least 80% of the width W, alternatively at least 90% of the width W, and the suction chamber 98 can extend at least 60% of the width W, alternatively at least 70% of the width W, alternatively at least 80% of the width W, alternatively at least 90% of the width W.

The brushroll 54 can be a hybrid brushroll suitable for use on both hard and soft surfaces, and for wet or dry vacuum cleaning. In one embodiment, the brushroll 54 comprises a plurality of bristles 118 and microfiber material 120. Bristles 118 can be tufted or unitary bristle strips and constructed of nylon, or any other suitable synthetic or natural fiber. The microfiber material 120 can be constructed of polyester, polyamides, or a conjugation of materials including polypropylene or any other suitable material known in the art from which to construct microfiber. Other embodiments of the brushroll 54 including a bristle brushroll suitable for use on soft surfaces, and that comprises bristles and no microfiber material, and/or a microfiber brushroll suitable for use on hard surfaces and that comprises microfiber material and no bristles. In one embodiment, the floor cleaner 10 can be provided with multiple, interchangeable brushrolls, which allows for the selection of a brushroll depending on the cleaning task to be performed or depending on the floor type of be cleaned.

Referring to FIG. 4, the base 64 can include an interference wiper 122 interfacing with a portion of the brushroll 54. The interference wiper 122 is disposed forwardly of the vapor generator 18 and/or at a front side of the mixing chamber 94 to interface with a leading portion of the brushroll 54, as defined by a direction of rotation R of the brushroll 54 about its rotational axis B. With this arrangement, a wetted portion brushroll 54 rotates past the interference wiper 122, which scrapes excess liquid off the brushroll 54 and/or distributes liquid more evenly across the brushroll 54, before reaching the surface to be cleaned. Optionally, the interference wiper 122 can be disposed to contact the brushroll 54 at an upper forward quadrant of the brushroll 54.

The interference wiper 122 may define the forward end of the mixing chamber 94. By pressing into the microfiber or other compressible material of the brushroll 54, the interference wiper 122 creates a seal with material of the brushroll 54 to prevent vapor from escaping at the front of the cover 96. Accordingly, the mixing chamber 94 may, in at least some embodiments, be defined at least in part as between the partition 102 and the interference wiper 122.

By way of non-limiting example, the wiper 122 can be integrally formed with or attached to the cover 96. Accordingly, removal of the cover 96 from the base housing 68 can also remove the wiper 122 from the base housing 68.

The wiper 122 can be rigid, i.e., stiff, and non-flexible, so the wiper 122 does not yield or flex by engagement with the brushroll 54. Optionally, the wiper 122 can be formed of rigid thermoplastic material, such as poly(methyl methacrylate) (PMMA), polycarbonate, or acrylonitrile butadiene styrene (ABS). In other embodiments, the wiper 122 can be flexible.

Figure 5:
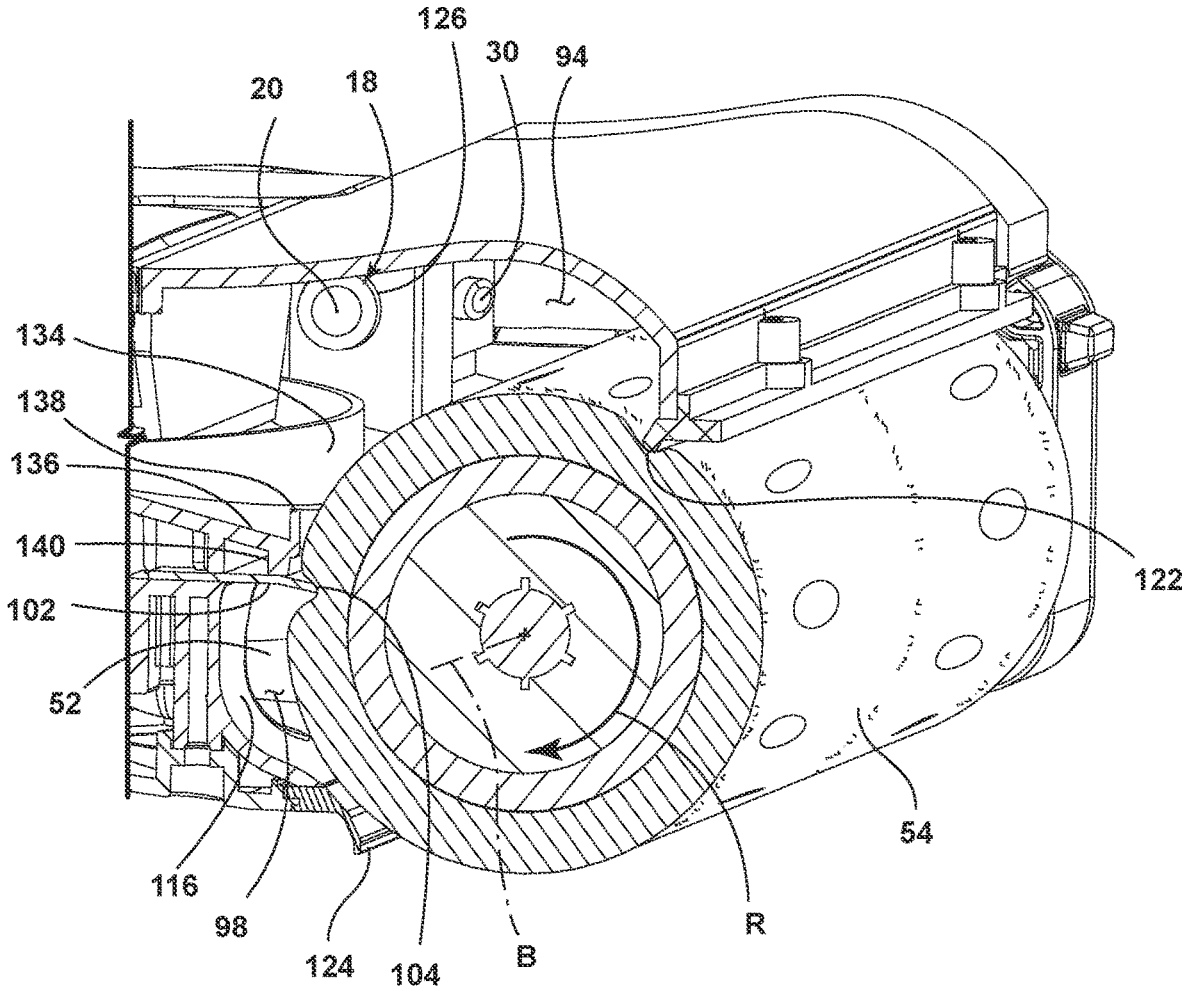
FIG. 5 is a perspective cross-sectional view of a portion of the base taken through line V-V of FIG. 2.

Referring to FIGS. 4-6, the base 64 can include a squeegee 124 adapted to contact the surface to be cleaned. The squeegee 124 is disposed at a rear side of the brushroll 54 and/or outside the mixing chamber 94. The squeegee 124 wipes residual liquid from the surface as the base 64 moves across the surface so that it can be drawn into the recovery pathway via the suction inlet port 52, thereby leaving a moisture and streak-free finish on the surface to be cleaned.

By way of non-limiting example, the squeegee 124 can be mounted to an underside of the base 64 and can project toward the surface to be cleaned. The squeegee 124 can, in one embodiment, be attached to or otherwise extend from the bottom edge of the rear chamber wall 116 defining the suction chamber 98. This provides for smooth movement of liquid up the squeegee 124 and into the suction chamber 98.

The squeegee 124 can be pliant, i.e., flexible or resilient, in order to bend readily according to the contour of the surface to be cleaned yet remain undeformed by normal use of the floor cleaner 10. Optionally, the squeegee 124 can be formed of a resilient polymeric material, such as ethylene propylene diene monomer (EPDM) rubber, polyvinyl chloride (PVC), a rubber copolymer such as nitrile butadiene rubber, or any material known in the art of sufficient rigidity to remain substantially undeformed during normal use of the floor cleaner 10.

Figure 7:
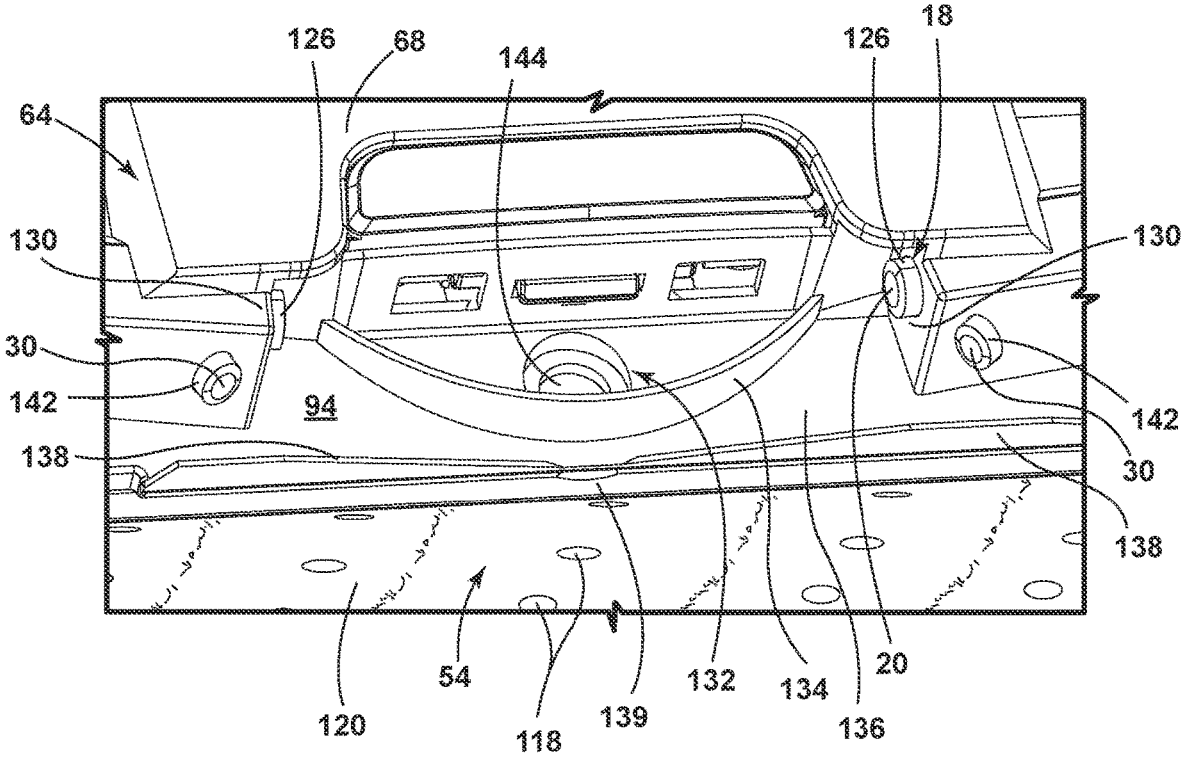
FIG. 7 is a close-up view showing a vapor generator, mixing chamber, and vibration generator of the base.

Referring to FIG. 7, in one aspect of the disclosure, the vapor generator 18 comprises at least one a high-pressure spray nozzle 126 comprising an outlet orifice forming the vapor outlet 20. The high-pressure spray nozzle 126 is configured to receive liquid cleaning fluid and to expel vapor through the outlet orifice or vapor outlet 20. For example, the nozzle 126 generates vapor from liquid cleaning fluid by forcing liquid through a small orifice using high pressure in order to produce vapor discharged through the outlet orifice or vapor outlet 20. The pump 24 (FIG. 3) pressurizes the supply path 22 (FIG. 1), thereby providing pressurized cleaning fluid to the high-pressure spray nozzle 126.

In one embodiment, the high-pressure spray nozzle 126 has an orifice diameter (e.g., opening diameter of the outlet orifice forming the vapor outlet 20) of about 0.1-0.6 mm and delivers about 3.0 to 380 mL/min of vapor when pressure is about 3 to 70 bar (300 to 7,000 kPa), the vapor having an average diameter of about 30-100 microns, alternatively about 30-50 microns. In another embodiment, the high-pressure spray nozzle 126 has an orifice diameter of about 0.25 and delivers about 30 to 40 mL/min of vapor when pressure is about 2 to 10 bar (200 to 1,000 kPa), the vapor having an average diameter of about 30-50 microns. The vapor output by a spray nozzle 126 according to either set of parameters evenly wets the brushroll 54 to clean the floor surface with minimal dry time and without streaking of moisture on the floor surface being cleaned.

The high-pressure spray nozzle 126 can be adjustable, i.e., have an adjustable orifice size to adjust the droplet size of the vapor produced, or non-adjustable, i.e., have a fixed orifice size to produce vapor having a predetermined average droplet size. Examples of a suitable adjustable high-pressure spray nozzle 126 have the parameters given above. It is understood that other adjustable and non-adjustable high-pressure spray nozzles can function to deliver vapor according to the aspects of the floor cleaner 10 described herein.

In one arrangement, the vapor generator 18 comprises a plurality of high-pressure spray nozzles 126 including at least two high-pressure spray nozzles 126. The nozzles 126 can be spaced from each other, such as being disposed at or near opposite sides of the mixing chamber 94. As shown in FIG. 3, the high-pressure spray nozzles 126 can be connected to the pump 24, optionally via the heater 26 and/or diverter valve 32 if present, via a fluid supply conduit that includes a T-connector 128 that splits the cleaning fluid between the two nozzles 126.

The base 64 can comprise mounts 130 for the nozzles 126. The nozzles 126 can be positioned in the base 64 via the nozzle mount 130. Although the nozzles 126 may be mounted in other ways, the nozzle mounts 130 can conveniently position the nozzles 126 at a desired angle. Each nozzle mount 130 position mount the nozzle 126 within or partially within the mixing chamber 94, such that the outlet 20 dispense vapor into the mixing chamber 94.

The nozzles 126 can be mounted at various orientations, including at various angles, with respect to the brushroll 54. Preferably, the nozzles 126 are mounted such that vapor is directed into the open space of the mixing chamber 94, rather than being directed immediately into the brushroll 54. For example, in one embodiment as shown in FIG. 7, the nozzles 126 are positioned for a tilt spray, with the vapor outlets 20 at an incline to the brushroll 54. In another embodiment (not shown), the nozzles 126 are positioned for direct spray, with the with the vapor outlets 20 generally orthogonal to the brushroll 54.

In one aspect, the vapor dispensing system 12 includes a vibration generator 132 configured to generate vapor from condensed cleaning fluid in the mixing chamber 94 using high frequency mechanical oscillation. The vapor dispensed by the vapor generator 18 can, in some cases, condense on the walls and/or surfaces defining the mixing chamber 94, including, but not limited to, on the inside of the cover 96. Such condensation can drip onto the brushroll 54, leading to uneven wetting of the brushroll 54. Additionally, such condensation can leak out of the floor cleaner 10 after a cleaning operation is completed. The vibration generator 132 vibrates at least some of, or most of, the condensed liquid, which is atomized into vapor that is released back into the mixing chamber 94. As such, uneven wetting and leaking of condensation can be reduced or prevented.

The vibration generator 132 can be adapted to vibrate within a frequency range of 1.0 kHz to 10 MHz to convert condensed liquid cleaning fluid into vapor. Some non-limiting examples of a suitable vibration generator 132 include, but are not limited to, a piezoelectric transducer, wherein the piezoelectric transducer is adapted to vibrate within a frequency range of 1.0 kHz-2.5 MHz, or an ultrasonic generator configured to vibrate at a frequency of 20 kHz or greater, alternatively 1.7 MHz to 2.5 MHz.

In one arrangement, where the vapor generator 18 comprises a plurality of high-pressure spray nozzles 126 including at least a first high-pressure spray nozzle and a second high-pressure spray nozzle, and the vibration generator 132 is disposed intermediate the two spray nozzles 126. The vibration generator 132 is thereby positioned centrally to both nozzles 126 and can further reduce the size of vapor within the mixing chamber 94 and improve vapor distribution.

Referring to FIGS. 4 and 7, the vibration generator 132 can include an annular piezoelectric transducer 144 within the mixing chamber 94 and can be adapted to convert signals received from an electronic controller (not shown) into mechanical vibrations. The electronic controller can include a PCB within the base 64 configured to provide output signals to the piezoelectric transducer 144. Alternatively, the piezoelectric transducer 144 can be controlled by controller 62 (FIG. 1).

A reservoir wall 134 can at least partially surround the vibration generator 132. The reservoir wall 134 extends upwardly from a base wall 136 that can define, at least in part, a bottom wall of the mixing chamber 94. The reservoir wall 134 creates a reservoir in which liquid pools on and around the vibration generator 132. The vibration generator 132 may operate most effectively with a certain height of liquid above the piezoelectric transducer 144 (or other vibrational element), and the reservoir wall 134 can collect and retain liquid over the transducer 144. Other structures forming a reservoir for the vibration generator 132 are possible.

In some embodiments, at least one wall 138 can extend upwardly from the base wall 136 of the mixing chamber 94, behind the brushroll 54. As shown in FIG. 7, two walls 138 may be provided, and are spaced apart to define an opening 139 at or near the center of the mixing chamber 94. The walls 138 serve to guide condensed water to evenly distribute along the brushroll 54.

With reference to FIGS. 4-6, in one embodiment, the base wall 136 or a portion of the base wall 136 can be angled downwardly in a forward direction, e.g., toward the brushroll 54, so that at least some condensed liquid that accumulates on base wall 136 can flow toward the brushroll 54 by gravity. Condensed liquid may, for example, flow down the base wall 136 and through the opening 139 between the walls 138 to wet the brushroll 54.

Optionally, the base wall 136 may apply a downward force on the partition 102 to stiffen the partition 102 and may prevent or at least lessen flexing of the partition 102 caused by the rotation of the brushroll 54. In one embodiment, a stub 140 depends from the underside of the base wall 136 and presses down on the top side of the partition 102.

The floor cleaner 10 can, in some embodiments, include a liquid dispenser 142 comprising the liquid outlet 30. The liquid dispenser 142 can comprise various structures, such as a nozzle, a spray tip, or a manifold, and can comprise at least one liquid outlet for dispensing liquid cleaning fluid to the surface to be cleaned. The dispenser 142 can be disposed on the base 64 and positioned to deliver liquid cleaning fluid onto the brushroll 54, into the brushroll chamber 56, and/or onto a surface below the base 64 such as a tray 150 (FIG. 2).

In one arrangement, the floor cleaner 10 comprises a plurality of liquid dispensers 142, including at least two liquid dispensers 142. The liquid dispensers 142, can be spaced from each other and can each comprise a liquid outlet 30. The dispensers 142 can be connected to the diverter valve 32 via a fluid supply conduit that includes a T-connector (not shown) that splits the cleaning fluid between the two dispensers 142.

With reference to FIGS. 1-3, in one aspect of the disclosure, the floor cleaner 10 can have at least one user-selectable cleaning modes, such as a vapor wash mode, a drying vacuuming mode, a self-cleaning mode, or any combination thereof. The modes can have associated operating parameters for the pump 24, the heater 26, the diverter valve 32, the vacuum motor 46, the brushroll motor 58, or the vibration generator 132, or any combination thereof. In one embodiment, the floor cleaner 10 has multiple vapor wash modes, including a first vapor wash mode and a second vapor wash mode, a dry vacuuming mode, and a self-cleaning mode. The controller 62 can execute a cleaning mode. The user can provide input to the controller 62 for the execution of a cleaning mode via the user interface 82, alternatively via the mode button 88.

In one embodiment of the first vapor wash mode, the pump 24, vacuum motor 46, and brush motor 58 are activated, e.g., powered by the power source 60. Vapor is dispensed from the vapor outlet 20, and the brushroll 54 may rotate during vapor dispensing. Suction is drawn at the suction inlet port 52 by the vacuum motor 46. The vibration generator 132, if present, can be activated during the first vapor wash motor, or may remain off to conserve power. The heater 26, if present, is not activated during the first vapor wash mode.

In one embodiment of the second vapor wash mode, the pump 24, heater 26, vacuum motor 46, and brush motor 58 are activated, e.g., powered by the power source 60. The vibration generator 132, if present, can also be activated during the second vapor wash mode. Heated vapor is dispensed from the vapor outlet 20, and the brushroll 54 may rotate during heated vapor dispensing. Suction is drawn at the suction inlet port 52 by the vacuum motor 46 and the vibration generator 132 converts condensed liquid back into vapor.

In one embodiment of the dry vacuuming mode, the vacuum motor 46 and brush motor 58 are activated, e.g., powered by the power source 60. In the dry vacuuming mode, vapor is not dispensed, and the pump 24 is deactivated. The heater 26 and vibration generator 132, if present, are not activated during the dry vacuuming mode.

In one embodiment of the self-cleaning mode, the floor cleaner 10 executes an automatic, unattended clean-out cycle in which the diverter valve 32 supplies liquid cleaning fluid to the bypass conduit 28. During the clean-out cycle, the pump 24, vacuum motor 46, and brush motor 58 are activated in an automated sequence, and cleaning fluid is sprayed on the brushroll 54 via the liquid outlet 30, the brushroll 54 rotates, and liquid is extracted and deposited into the recovery container 48, thereby also flushing out the suction chamber 98 (FIG. 4) and the recovery path 22. The vacuum motor 46, pump 24, and brush motor 58 can be active individually or simultaneously, and for any predetermined times, including overlapping and non-overlapping times. For example, the vacuum motor 46, pump 24, and brush motor 58 can be activated at once. In another example, the pump 24 and brush motor 58 can be activated for a first predetermined period, and the vacuum motor 46 activated after. In yet another example, the pump 24 can be activated for a first predetermined period, the brush motor 58 can be activated for a second predetermined period after the pump 24 is de-activated, and the vacuum motor 46 activated during or after activation of the pump 24 and/or brush motor 58. Yet other clean-out cycles are possible. The self-cleaning mode can be configured to last for a predetermined amount of time or until the cleaning fluid in the supply container 40 has been depleted.

By way of non-limiting example, in one self-cleaning mode, the pump 24 and brush motor 58 are activated for 10 seconds, then the brush motor 58 remains on for an additional 10 seconds while the pump 24 is de-activated to spin the brushroll 54 without additional fluid delivery, and finally the brush motor 58 remains on for an additional 20 seconds while vacuum motor 46 is activated. In total, the clean-out cycle lasts for 40 seconds.

In the self-cleaning mode, the heater 26, if present, can be activated and heated cleaning liquid can be dispensed. In yet another embodiment of the self-cleaning mode, the heater 26 is not activated, and the cleaning liquid dispensed from the liquid outlet 30 is not heated.

While the operating parameters may vary, in one example during the self-cleaning mode, the vacuum and brush motors 46, 58 can operate at the same parameters as the vapor wash modes, and the pump 24 can operate at a higher flow rate to flush out the recovery pathway 42.

In another aspect of the disclosure, the floor cleaner 10 can have at least one liquid wash mode in which liquid cleaning fluid is dispensed to clean a surface. In one embodiment of the liquid wash mode, the pump 24, heater 26, vacuum motor 46, and brush motor 58 are activated, e.g., powered by the power source 60. Heated cleaning liquid is dispensed from the liquid outlet 30, and the brushroll 54 may rotate during heated liquid dispensing. Suction is drawn at the suction inlet port 52 by the vacuum motor 46. In yet another embodiment of the liquid wash mode, the heater 26 is not activated, and the cleaning liquid dispensed from the liquid outlet 30 is not heated. The vibration generator 132, if present, can be activated during the liquid wash mode, or may remain off to conserve power. With the vibration generator 132 activated, at least some vapor is generated in the liquid wash mode. More liquid than vapor may be output by the floor cleaner 10 in the liquid wash mode.

Table 1 below lists some non-limiting examples of operating parameters for the modes. For the pump 24, some optional flow rates are also listed, although it is understood that the pump 24 may operate at one flow rate in all modes when "on." Other operating parameters for the modes and other cleaning modes are possible.

TABLE 1

| Mode | | Pump | Heater | Vibration Generator | Vacuum Motor | Brush Motor |
|---|---|---|---|---|---|---|
| 1st Vapor Wash | ON | LOW | OFF | ON | ON | ON |
| 2nd Vapor Wash | ON | LOW | ON | ON | ON | ON |
| Dry Vacuum | OFF | OFF | OFF | OFF | ON | ON |
| Liquid Wash | ON | MEDIUM | ON | ON | ON | ON |
| Self-Cleaning | ON | HIGH | ON | OFF | ON | ON |

Table 2 below lists some non-limiting examples of operating parameter values for the modes, including a preferred value for some parameters. These values are based on a vapor orifice diameter of 0.25 mm and a liquid orifice diameter of 0.5 mm. Other operating parameters for the modes are possible.

TABLE 2

| Mode | Pump Flow Rate (mL/min) | Heater Power (W) |
|---|---|---|
| 1st Vapor Wash | 35 | 0 |
| 2nd Vapor Wash | 35 | 180 |
| Dry Vacuum | 0 | 0 |
| Liquid Wash | 50 | 180 |
| Self-Cleaning | 120 | 180 |

In the vapor wash and liquid wash modes (e.g., user-operated or attended modes), the release of cleaning fluid can be manually controlled by the user, for example using the trigger 84 (FIG. 2). In the unattended self-cleaning mode, the release of cleaning fluid is automatic. In an alternative embodiment, the release of cleaning fluid during user-operated or attended modes can be continuous or automatic, e.g., does not require pressing a trigger.

Referring to FIG. 2, the floor cleaner 10 can be provided with a tray 150 that can be used to store and/or to self-clean the floor cleaner 10. The tray 150 can be configured to receive the base 64 of the floor cleaner 10 in an upright, stored position. The tray 150 can further be configured for further functionality, such as for charging the floor cleaner 10 in embodiments where the power source 60 (FIG. 1) of the floor cleaner 10 is a rechargeable battery. In some embodiments, the tray 150 can function as a cleaning tray during the self-cleaning mode.

In one aspect of the disclosure, operation of the self-cleaning mode may require that the floor cleaner 10 be docked on a tray 150 and/or another condition for self-cleaning be met. When not docked and/or when another condition for self-cleaning is not met, the clean-out cycle may be inoperable, e.g., selection of the clean-out cycle button 90 (FIG. 2) will not activate the self-cleaning mode.

To the extent not already described, the different features and structures of the various embodiments of the invention, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various vacuum cleaner configurations as desired to form new embodiments, whether or not the new embodiments are expressly described.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus, comprising:

an upright body comprising a handle and a frame;

a base coupled with the upright body and adapted for movement across a surface to be cleaned, the base comprising a brushroll chamber;

a brushroll in the brushroll chamber, the brushroll rotatable about a brushroll axis;

a recovery system comprising a suction inlet port in fluid communication with the brushroll chamber, a recovery tank, and a vacuum motor;

a liquid dispenser disposed on the base, the liquid dispenser configured to dispense liquid cleaning fluid;

a vapor dispensing system comprising:

a supply container configured to store a liquid cleaning fluid;

a pump in fluid communication with the supply container;

a vapor generator in fluid communication with the pump and configured to receive liquid cleaning fluid from the supply container via the pump and to expel the cleaning fluid as vapor; and a mixing chamber within the brushroll chamber, wherein the vapor generator comprises a vapor outlet that dispenses vapor into the mixing chamber to wet the brushroll; and a bypass conduit that bypasses the vapor generator to supply liquid cleaning fluid to the liquid dispenser.

2. The surface cleaning apparatus of claim 1, comprising a suction chamber within the brushroll chamber, wherein the suction inlet port is in fluid communication with the suction chamber, and the mixing chamber is substantially fluidly isolated from the suction chamber.

3. The surface cleaning apparatus of claim 2, wherein a volume of the mixing chamber is greater than a volume of the suction chamber.

4. The surface cleaning apparatus of claim 2, comprising a partition within the brushroll chamber, the partition separating the mixing chamber from the suction chamber.

5. The surface cleaning apparatus of claim 4, wherein the partition is disposed rearwardly of the brushroll, the mixing chamber is defined above the partition, and the suction chamber is defined below the partition.

6. The surface cleaning apparatus of claim 4, wherein the partition contacts the brushroll.

7. The surface cleaning apparatus of claim 6, wherein the partition projects 2 to 5 mm into the brushroll.

8. The surface cleaning apparatus of claim 1, wherein the base comprises a squeegee adapted to contact the surface to be cleaned, and wherein the squeegee is disposed at least one of:

at a rear side of the brushroll; and outside the mixing chamber.

9. The surface cleaning apparatus of claim 1, wherein the base comprises an interference wiper interfacing with a portion of the brushroll, and wherein the interference wiper is disposed at least one of:

forwardly of the vapor outlet; and at a front side of the mixing chamber.

10. The surface cleaning apparatus of claim 1, wherein the vapor generator comprises a high-pressure spray nozzle comprising an outlet orifice forming the vapor outlet, wherein the high-pressure spray nozzle comprises an orifice diameter of 0.1-0.6 mm and delivers vapor at a rate of 3.0 to 380 mL/min under a pressure of 300 to 7000 kPa.

11. The surface cleaning apparatus of claim 1, wherein the vapor dispensing system comprises a vibration generator configured to generate vapor from condensed cleaning fluid in the mixing chamber, wherein the vibration generator comprises at least one of:

a piezoelectric transducer configured to vibrate within a frequency range of 1.0 kHz-10 MHz; and an ultrasonic generator configured to vibrate at a frequency of at least 20 kHz.

12. The surface cleaning apparatus of claim 11, wherein the vapor generator comprises a plurality of high-pressure spray nozzles including at least a first high-pressure spray nozzle and a second high-pressure spray nozzle, and wherein the vibration generator is disposed intermediate the first high-pressure spray nozzle and the second high-pressure spray nozzle.

13. The surface cleaning apparatus of claim 1, wherein the vapor dispensing system comprises a heater configured to provide heated liquid cleaning fluid to the vapor generator.

14. The surface cleaning apparatus of claim 1, wherein the vapor outlet is configured to dispense vapor comprising droplets having at least one of a diameter of about 30-50 microns and a temperature of less than 100 °C.

15. The surface cleaning apparatus of claim 1, comprising a controller to control the operation of the recovery system and the vapor dispensing system, wherein the controller is configured to execute at least two of:

a first vapor wash mode where the pump and the vacuum motor are powered, and vapor is dispensed to the mixing chamber at a first temperature;

a second vapor wash mode where the pump and the vacuum motor are powered, a heater in fluid communication with the pump is powered, and vapor is dispensed to the mixing chamber at a second temperature that is greater than the first temperature; and a self-cleaning mode in which an unattended, automatic cleanout cycle is executed to clean at least a portion of the recovery system.

16. A surface cleaning apparatus, comprising:

an upright body comprising a handle and a frame;

a base coupled with the upright body and adapted for movement across a surface to be cleaned, the base comprising a brushroll chamber and a cover at least partially defining the brushroll chamber;

a brushroll in the brushroll chamber, the brushroll rotatable about a brushroll axis;

a recovery system comprising a suction inlet port in fluid communication with the brushroll chamber, a recovery tank, and a vacuum motor;

a liquid dispenser disposed on the base, the liquid dispenser configured to dispense liquid cleaning fluid;

a vapor dispensing system comprising:

a supply container configured to store a liquid cleaning fluid;

a pump in fluid communication with the supply container;

a vapor generator in fluid communication with the pump and configured to receive liquid cleaning fluid from the supply container via the pump and to expel the cleaning fluid as vapor; and a mixing chamber within the brushroll chamber, wherein the vapor generator comprises a vapor outlet that dispenses vapor into the mixing chamber to wet the brushroll; and a bypass conduit that bypasses the vapor generator to supply liquid cleaning fluid to the liquid dispenser;

wherein a portion of the mixing chamber is defined between a top of the brushroll and an underside of the cover; and wherein the mixing chamber comprises a clearance of at least 5 mm between the top of the brushroll and the underside of the cover.

17. The surface cleaning apparatus of claim 16, wherein at least a portion of the cover is transparent or translucent to permit a user to view the mixing chamber and observe the dispensing of vapor through the cover.

18. The surface cleaning apparatus of claim 16, wherein the base comprises a base housing and the cover is releasably attached to the base housing, wherein the cover is removable to access the brushroll.

* * * * *